US010238214B1

(12) United States Patent
Haythornthwaite

(10) Patent No.: US 10,238,214 B1
(45) Date of Patent: Mar. 26, 2019

(54) BACKPACK TYPE FOLDING CHAIR

(71) Applicant: Shedrain Corporation, Portland, OR (US)

(72) Inventor: David Haythornthwaite, Fujian Province (CN)

(73) Assignee: SHEDRAIN CORPORATION, Portland, OR (US)

( * ) Notice: Subject to any disclaimer, the term of this patent is extended or adjusted under 35 U.S.C. 154(b) by 0 days.

(21) Appl. No.: 15/791,753

(22) Filed: Oct. 24, 2017

(51) Int. Cl.
*A45F 4/02* (2006.01)
*A47C 4/28* (2006.01)

(52) U.S. Cl.
CPC ..... *A47C 4/28* (2013.01); *A45F 4/02* (2013.01); *A45F 2004/026* (2013.01)

(58) Field of Classification Search
CPC ..... A45F 2004/026; A47C 4/52; A47C 13/00
USPC ..... 224/155
See application file for complete search history.

(56) References Cited

U.S. PATENT DOCUMENTS 4,487,345 A 12/1984 Pierce et al.
5,588,696 A 12/1996 Jay
6,592,012 B2 * 7/2003 Godshaw ..... A45F 3/04 190/115
6,601,743 B2 * 8/2003 Godshaw ..... A45C 9/00 190/113
6,923,352 B2 * 8/2005 Oh ..... A45C 5/14 190/1
RE39,022 E 3/2006 Welsh
7,118,172 B1 * 10/2006 Pattison-Sheets ..... A45F 4/02 297/129
9,173,495 B2 * 11/2015 Goldszer ..... A47C 4/00
9,185,983 B1 * 11/2015 Cohen ..... A47C 4/52
2013/0214565 A1 * 8/2013 Nickell ..... A47C 1/143 297/30

* cited by examiner

*Primary Examiner* — Adam J Waggenspack
(74) *Attorney, Agent, or Firm* — Leason Ellis LLP

(57) ABSTRACT

A backpack type folding chair is provided and includes a chair frame including a seat frame, a back frame, a front leg frame, and a back leg frame. At least one support panel to support a user is coupled about the back frame and the seat frame. A first storage receptacle is coupled to a rear face of a backrest portion of the at least one support panel that is coupled to the back frame. In addition, a second storage receptacle is defined between the first storage receptacle and the backrest portion. A pair of detachable shoulder straps are provided with each strap includes a first end that is attached along the rear face of the backrest portion and a second end that includes a first fastener that is configured to mate with a coupling member that is attached to the at least one support panel proximate the cross member for attaching the second end of the shoulder strap to the chair and permit carrying of the chair in a folded position. The pair of shoulder straps can be stored in the second storage receptacle when the chair is in an in-use position.

22 Claims, 6 Drawing Sheets

BACKPACK TYPE FOLDING CHAIR

TECHNICAL FIELD

The present invention is directed to a portable backpack chair (backpack unit) and more particularly, to a backpack chair that includes a storage container and detachable backpack straps for easily configuring the backpack chair between a wearable backpack unit and a folding chair.

BACKGROUND

There are many different types of chairs that are commonly used in various settings including for the house and for outside. For those chairs that are intended for use outdoors, there are also many different types of chairs that can be formed of any number of different materials. One type of outdoor chair is a convertible or folding chair that can easily assume two different states, namely, a folded state and an unfolded (in-use) state. Folding chairs are often used at the beach or similar setting and often, a person needs to carry the folded chair some distance to the area at which the chair is used. Not only is the chair required to be carried but most times, the person needs to carry additional items, such as beach accessories, food and drink, etc. Carrying the chair thus becomes a very cumbersome process.

While a backpack type chair is known, there are various deficiencies associated with each design and therefore, there is a need for an improved folding chair design that overcomes these deficiencies.

SUMMARY

In one embodiment, a backpack type folding chair is provided and includes a chair frame including a seat frame, a back frame, a front leg frame, and a back leg frame. The back frame is pivotally adjustable relative to the seat frame and the front leg frame and the back leg frame being pivotally coupled to one another. The seat frame has a cross member extending across legs of the seat frame and the chair frame is configured to fold such that the back frame, the seat frame, the front leg frame and the back leg frame fold substantially parallel and adjacent to one another.

The folding chair includes a pair of arm rests that are pivotally coupled to the back frame and being configured to have a plurality of adjustment positions.

At least one support panel to support a user is coupled about the back frame and the seat frame and is associated with the cross-member.

In accordance with one embodiment, a first storage receptacle (compartment) is coupled to a rear face of a back rest portion of the at least one support panel that is coupled to the back frame. In addition, a second storage receptacle (compartment) is defined between the first storage receptacle and the back rest portion. A pair of detachable shoulder straps are provided with each strap includes a first end that is attached along the rear face of the back rest portion and a second end that includes a first fastener that is configured to mate with a coupling member that is attached to the at least one support panel proximate the cross member for attaching the second end of the shoulder strap to the chair and permit carrying of the chair in a folded position. The pair of shoulder straps can be fully stored in the second storage receptacle when the chair is in an in-use position and this can be hidden from view.

BRIEF DESCRIPTION OF THE DRAWING FIGURES

DETAILED DESCRIPTION OF CERTAIN EMBODIMENTS

Figure 1:
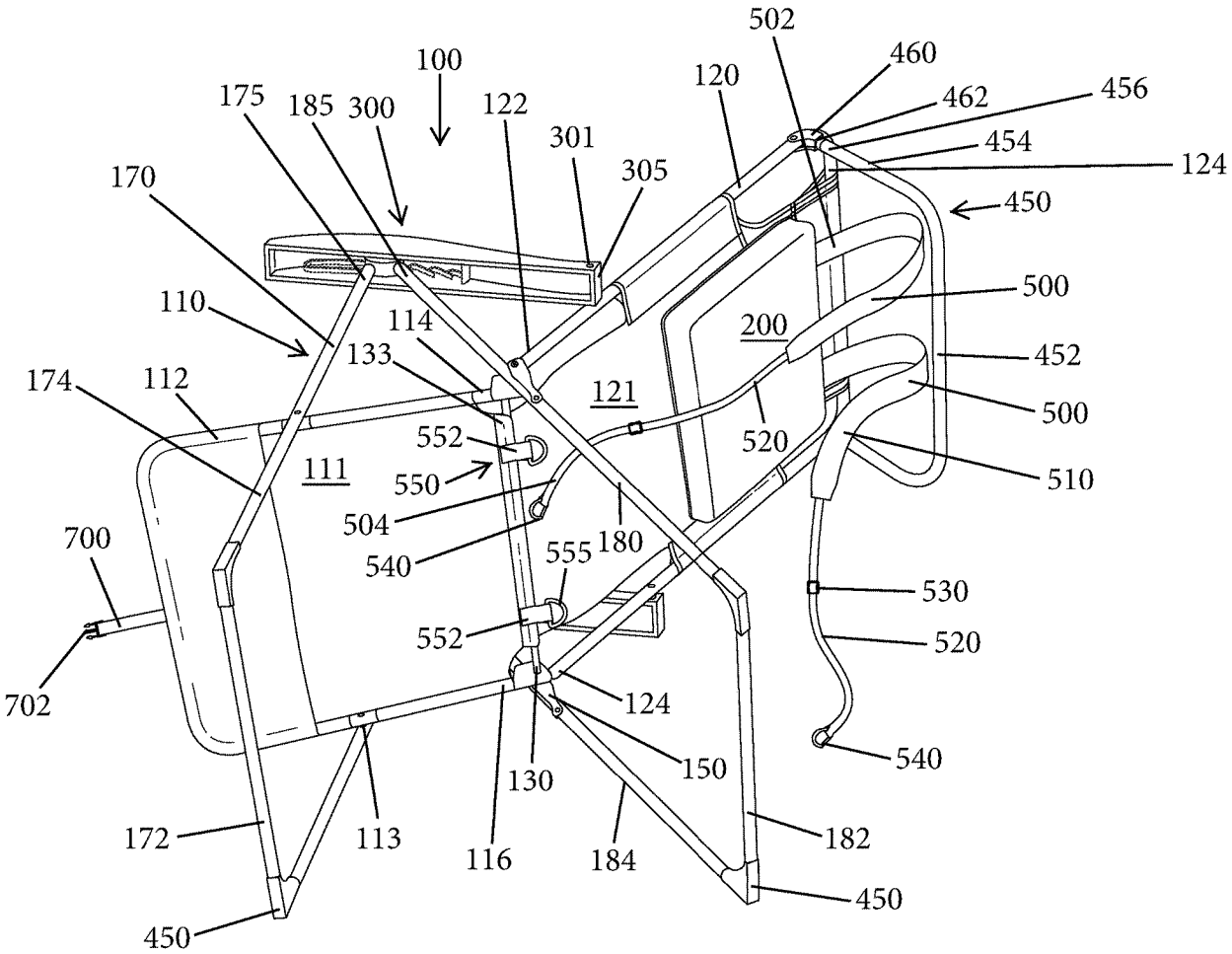
FIG. 1 is a bottom and side perspective view of a backpack type folding chair according to the present invention.

The present invention relates to a backpack unit or chair 100 that includes a foldable frame 110 that can function as a chair in that a seating area is defined. In this manner, the backpack chair 100 of the present invention provides a folding chair that can be easily carried over the shoulders of a user to various locations, including outdoor activities, like athletic events or the beach or a park.

As discussed herein, the frame 110 of the backpack chair 100 that forms a foldable chair portion of the chair 100 is made of a lightweight, durable material, including, but not limited to, a metal alloy, such as aluminum, aluminum alloy, steel, steel alloy, or a plastic material. In this manner, the frame 110 of the backpack chair 100 is preferably a lightweight material so that the weight of the backpack chair 100 is light enough to allow the chair 100 to also include a container (first storage receptacle) 400 for carrying one or more items. Thus, the backpack chair 100 includes a container portion (container/first storage receptacle 400) that allows for the storage and transport of a variety of goods, including sporting equipment and picnic supplies, such as food and drink, etc.

In one embodiment, the frame 110 of the backpack chair 100 is in the form of a folding chair that includes a U-shaped seat frame 112 that has a first free end 114 and an opposing second free end 116. The frame 110 also includes a U-shaped back frame 120 that has a first free end 122 and an opposing second free end 124. Typically, the U-shaped back frame 120 has greater dimensions than the U-shaped seat frame 112 (e.g., it has a greater length).

As shown in the figures, the U-shaped seat frame 112 includes a cross-bar 130 that extends between and is attached to the two legs of the U-shaped seat frame 112. The attachment points of the cross-bar 130 to the two legs is spaced from but proximate the free ends 114, 116 of the U-shaped seat frame 112. The cross-bar 130 can be in the form of a cylindrical shaped metal rod. The cross-bar 130 is usually formed of the same material as the remaining portions of the U-shaped seat frame 112.

In addition to the support frame (i.e., the U-shaped seat frame 112 and the U-shaped back frame 120), the chair 100 includes at least one support panel to support a user seated within the frame 112, 120. In one embodiment, the support panel can be formed of a durable material, such as a canvas, a polyester, or other cloth or cloth-like material. In one embodiment, when the support panel comprises a canvas material, the canvas is coupled to the apex of the U-shaped seat frame 112 and to the apex of the U-shaped back frame 120. The coupling can be accomplished by looping the canvas material, for example, over the apex of the U-shaped back frame 120 and sewing the looped portion of the back side of the support panel. A similar sewing procedure can be used to couple the support panel to the apex of the U-shaped seat frame 112. In one embodiment, the support panel can be made up of a seat panel 111 and a back panel 121. In the illustrated embodiment, the seat panel 111 and back panel 121 can be formed as part of a single length of support panel that is coupled to the cross bar 130 as well as being coupled at its ends to the apexes of the U-shaped seat frame 112 and the U-shaped back frame 120 as described herein. In particular, the support panel is wrapped over the cross bar 130 and is then stitched to itself so as to create a pocket 133 that contains the cross bar 130 as shown. The pocket 133 is thus defined by one section of support panel on one side of the cross bar 130 and another section of the support panel on the other side of the cross bar 130.

A first bracket or connector 140 is provided for coupling the U-shaped back frame 120 to the U-shaped seat frame 112. The first bracket 140 has a curved closed end 142 and a pair of opposing side walls 144 that extend upwardly from the curved closed end 142. As show, the first bracket 140 can have a U-shape with the closed end 142 defining a floor between the parallel, opposing side walls 144. The opposing side walls 144 can be at least substantially parallel to one another and each side wall 144 can have a triangular shape. The first bracket 140 is configured to mate with the legs of the U-shaped seat frame 112 in a pivoting manner and as shown, the pivoting can be positioned near one corner of the triangular shaped side wall 144. Each curved closed end 142 thus wraps around one respective end of the leg of the U-shaped seat frame 112.

One free end 122 of one of the legs of the U-shaped back frame 120 is received between the opposing side walls 144 of the first bracket 140 and is pivotally coupled to the first bracket 140. In particular, a pivot member 141, such as a pivot rod, fastener, or the like can pass through the opposing side walls 144 and through one end of one leg of the U-shaped back frame 120 so as to allow the U-shaped back frame 120 to freely pivot relative to the first bracket 140. This is therefore a pivot point between the U-shaped back frame 120 and the U-shaped seat frame 112.

It will be appreciated that the first free end 122 and the second free end 124 of the U-shaped back frame 120 are not directly attached to the free ends 114, 116 of the U-shaped seat frame 112. Instead, the first free end 122 and the second free end 124 of the U-shaped back frame 120 are coupled to the first bracket 140. It will also be seen from the figures, that the first free end 122 and the second free end 124 of the U-shaped back frame 120 are disposed internal to the first bracket 140; however, the first free end 122 and the second free end 124 of the U-shaped back frame 120 are disposed in the same plane as the free ends 114, 116 of the U-shaped seat frame 112. In other words, unlike previous backpack chair constructions, the U-shaped seat frame 112 and the U-shaped back frame 120 are not laterally spaced apart and are not required to be disposed in a side-by-side relationship. Instead, the U-shaped seat frame 112 and U-shaped back frame 120 can lie within the same plane.

The first bracket 140 is also coupled to the U-shaped seat frame 112. More specifically, one of the free end 114, 116 of the U-shaped seat frame 112 is coupled to the first bracket 140. As shown, the coupling point between the free end 114, 116 and the respective first bracket 140 is spaced from the free end 114, 116 itself and in particular, the free end 114, 116 of the U-shaped seat frame 112 is disposed within the first bracket 140 between the side walls of the first bracket 140. The coupling between the free end 114, 116 and the first bracket 140 can be by a fastener, such as a screw, as shown. Unlike the free ends 122, 124 of the U-shaped back frame 120 which are generally contained completely within the first bracket 140, the free end 114, 116 of the U-shaped seat frame 112 extends beyond the first bracket 140 and thus, likewise extends beyond the free end of the U-shaped back frame 120. Unlike the free end of the U-shaped back frame 120 which is pivotally coupled to the first bracket 140, the free end of the U-shaped seat frame 112 is not pivotally coupled but instead is fixedly connected since the free end 114, 116 of the U-shaped seat frame 112 is not intended to pivot relative to the first bracket 140. As a result, the first bracket 140 is fixedly attached to the U-shaped seat frame 112 and does not more relative thereto.

As shown, the free end 114, 116 of the U-shaped seat frame 112 is thus located below the free end of the U-shaped back frame 120; however, the coupling points between the U-shaped seat frame 112 and the first bracket 140 and the U-shaped back frame 120 are selected to allow the U-shaped back frame 120 to pivot above the U-shaped seat frame 112.

The first bracket 140 can be formed of any number of suitable materials, including but not limited to metal or plastic, etc.

It will be appreciated that the first bracket 140 is thus constructed to allow the U-shaped back frame 120 to pivot and open and close relative to the U-shaped seat frame 112 about the pivotal connection between the U-shaped back frame 120 and the first bracket 140.

A second connector 150 is provided for coupling the U-shaped seat frame 112 and the U-shaped back frame 120 to other components of the chair 100 as described herein. The second connector 150 comprises a structure that has a pair of first and second elongated side walls 152 with a cross member 154 connected to an extending between the side walls 152 proximate to a first end 151 of the side walls 152. As shown, the cross member 154 is a hollow member in that the pivot member 141 passes therethrough. The pivot member 141 thus passes through and across both the first bracket 140 and the second connector 150, as well as the U-shaped back frame 120. In this way, the pivot member 141 connects the first bracket 140 and the second connector 150 in a manner in which second connector 150 can pivot relative to the fixed first connector 140.

An outer surface of the cross member 154 can be contoured and in particular, the cross member 154 can generally have an hourglass shape in that the center of the cross member 154 has a waist defining the narrowest portion of the cross member 154. This allow, as described below, a tubular frame component to nest with the cross member 154 and in particular, the concave shaped waist of the cross member 154 is shaped and shaped to allow a cylindrical shaped tubular frame component (e.g., a leg member) to seat therein when the chair 100 is in a closed position as discussed herein.

The side walls 152 can thus represent two arms that extend from the first end 151 to a second end 153. At the second end 153, the second connector 150 is open in that the parallel spaced side walls 152 define and open space at the second end 153.

A spacer 160 can be formed as part of the second connector 150 or can be a separate part therefrom and is inserted between one side wall 144 of the first bracket 140 and one side wall 152 of the second connector 150. The spacer 160 creates a small space between the walls 144, 152 that face one another.

The chair 100 also includes a U-shaped front leg frame 170 and a U-shaped rear leg frame 180. The U-shaped front leg frame is defined by a base portion 172 and two leg portions 174 extending upright from the base portion 172 and being parallel to one another. Each of the leg portions 174 terminates in a free end 175. The U-shaped rear leg frame 180 has a similar construction in that it is defined by a base portion 182 and two leg portions 184 extending upright from the base portion 182 and being parallel to one another. Each of the leg portions 184 terminates in a free end 185.

As shown in the figures, the U-shaped rear leg frame 180 is coupled to the second connector 150. In particular, the U-shaped rear leg frame 180 is inserted into the second end 153 of the second connector 150 and is pivotally coupled to each side wall (leg) 152 of the second connector as by a fastener 155 passing through each of the second ends 153 and through the hollow tubular shaped U-shaped rear leg frame 180. The coupling point between the U-shaped rear leg frame 180 and the second connector 150 is between one free end 185 and a curved base portion 187 of the U-shaped rear leg frame 180 that extends between the leg portions of the U-shaped rear leg frame 180 and is configured to sit on the ground during use.

Figure 4A:
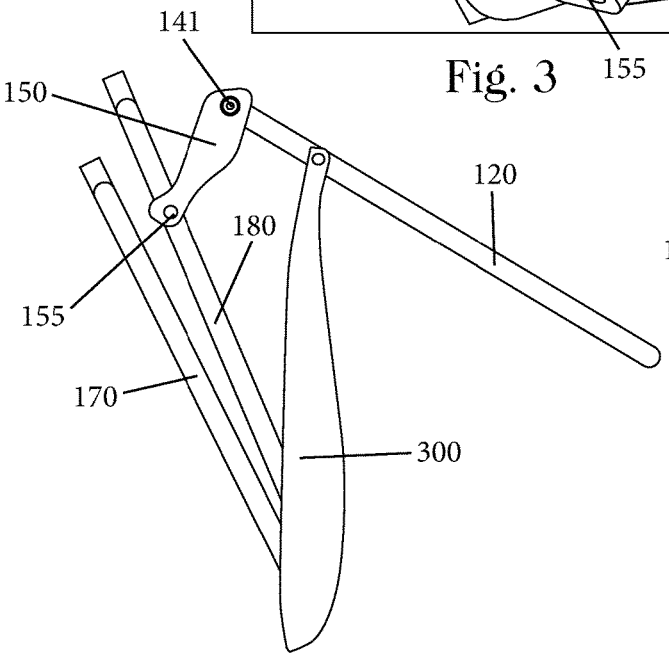
FIG. 4A is a side view of the folding chair shown in a partially folded position.
Figure 4B:
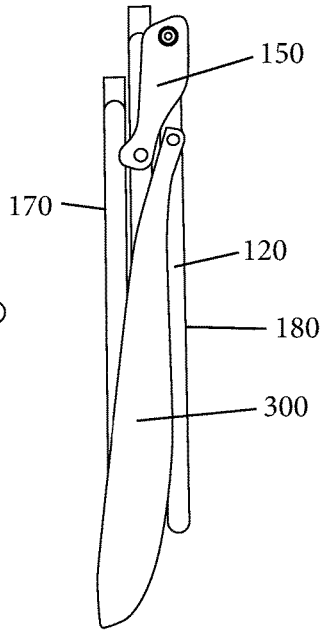
FIG. 4B is a side view of the folding chair shown in a fully closed position.
Figure 5:
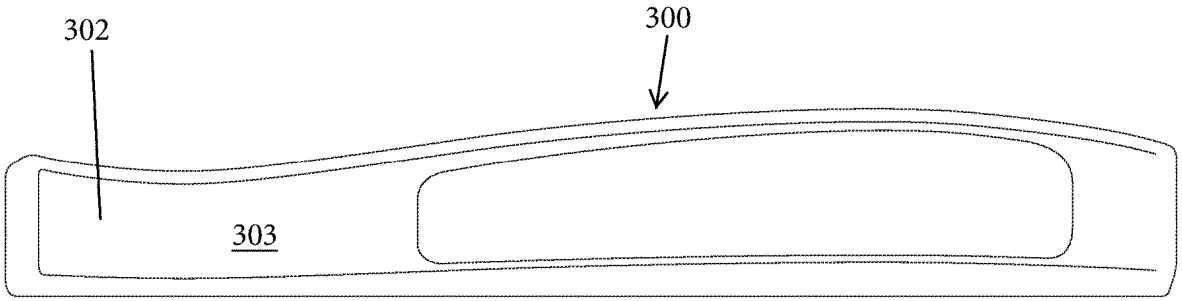
FIG. 5 is a top plan view of an arm rest of the folding chair.

The concave shaped waist of the cross member 154 receives one leg of the U-shaped rear leg frame 180 and is designed such that when the chair 100 is in a fully closed position, the U-shaped rear leg frame 180 seats against (and nests within) this concave shaped waist of the cross member 154 (See, FIG. 4B).

It will therefore be appreciated that the second connector 150 has two distinct pivot points that are defined by parallel axis that are spaced apart from one another. The connection between the second connector 150 and the U-shaped rear leg frame 180 serves as a means for indirectly attaching the U-shaped seat frame 112 and the U-shaped back frame 120 to the U-shaped rear leg frame 180.

Figure 6:
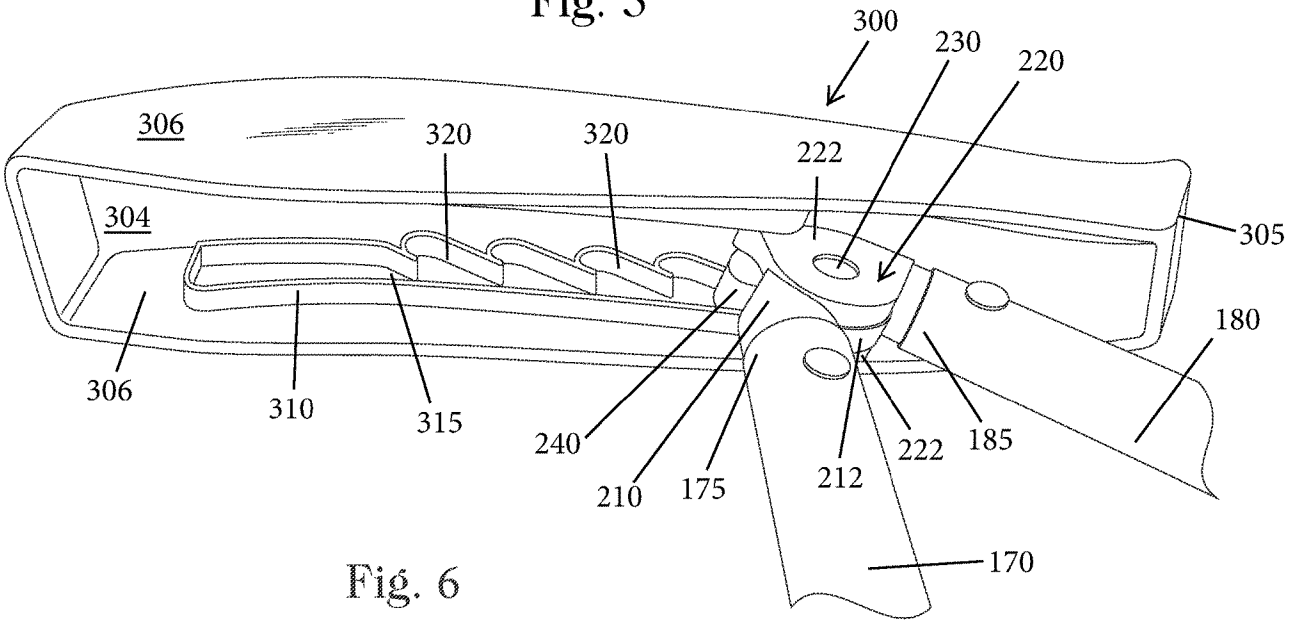
FIG. 6 is a bottom and side perspective view of the arm rest connected to ends of the front leg and rear leg.
Figure 7:
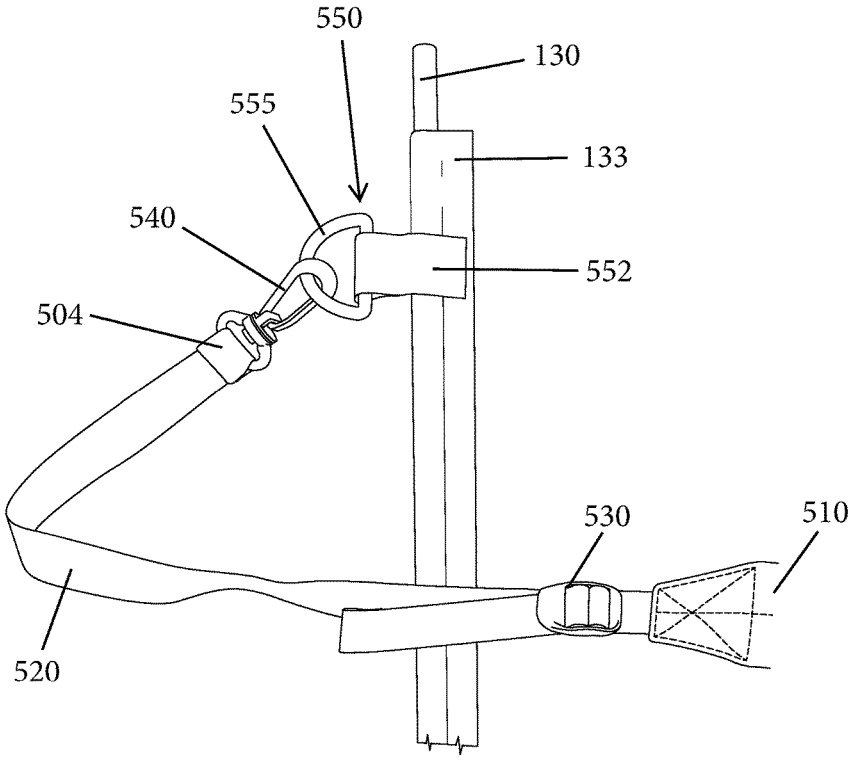
FIG. 7 is a perspective view of D-rings used for attachment to clips at the bottom ends of the straps.

As shown in FIG. 6, each of the free ends 175 of the U-shaped front leg frame 170 includes a first coupling member 210 and similarly, each of the free ends 185 of the U-shaped rear leg frame 180 includes a second coupling member 220. The first and second coupling members 210, 220 are constructed so as to be pivotally attached to one another. More the second coupling member 220 can have a pair of spaced arms 222 with a space formed therebetween. The first coupling member 210 has an extension 212 that is sized to be received within the space. A leg pivot 230 extends through the spaced arms 222 and the extension 212, thereby pivotally coupling the U-shaped front leg frame 170 and the U-shaped rear leg frame 180.

The pair of spaced arms 222 each includes an outwardly extending post 240. The two posts 240 are axially aligned with one another and, as described below, serve to lock the U-shaped front leg frame 170 and the U-shaped rear leg frame 180.

The U-shaped front leg frame 170 is also pivotally coupled to the U-shaped seat frame 112 and in particular, the U-shaped seat frame 112 includes an integral post 113 (FIG. 1) that extends outwardly therefrom proximate a forward end of the U-shaped seat frame 112. The two integral posts 113 are axially aligned with one another. Each post 113 can be a tubular structure that receives a fastener 10 for pivotally attaching the U-shaped seat frame 112. For example, the tubular post 113 can have inner threads that engage the threaded fastener 10 for pivotally attaching the U-shaped front leg frame 170 to the U-shaped seat frame 112. This connection allows the U-shaped front leg frame 170 to pivot relative to the U-shaped seat frame 112.

The chair 100 also includes a pair of arm rests 300. Each arm rest 300 is in the form of an elongated structure that has a top wall 302 that has a top surface 303 on which a user's arm can be placed and an opposite bottom surface 304. As shown, the arm rest 300 is constructed with a pair of side walls 306 and end walls 308 that depend downwardly from the top wall 302 so as to define a hollow space on the underside of the top wall 302. Along the inner surface of each of the side walls 306, there is a track 310 and therefore, the two tracks 310 of one arm rest 300 are located opposite one another in spaced apart relationship. The track 310 includes a main linear portion 315 and a number of slots 320 that communicate with the linear portion 315. Each of the outwardly extending post 240 is sized and shaped to freely travel within the linear portion 315 and be inserted into one slot 320. Each slot 320 can be angled relative to the linear portion 315 to allow for easy insertion of post 240 into one slot 320.

A rear end 305 of each arm rest 300 is coupled to the U-shaped back frame 120 to allow the U-shaped back frame 120 to pivot relative to the arm rest 300. A pivot, such as a fastener, 301 (FIG. 1) can be used. Each of the arm rests 300 can also pivot relative to the U-shaped back frame 120 to allow for lifting and lowering of the arm rests 300 to disengage or engage the posts 240 with the track features.

In order to change the position of the U-shaped back frame 120, the user simply lifts the arm rests 300 and moves them forward or backwards causing the posts 240 located with one respective arm rest 300 to move into the linear portion 315 and then inserted into a selected one of the slots 320. The selection of the slot 320 controls the angle of the U-shaped back frame 120 relative to the U-shaped seat frame 112.

The chair also includes a U-shaped rear frame 450 (FIG. 1) that is pivotally attached to the U-shaped back frame 120 proximate the closed end thereof. The U-shaped rear frame 450 has a base portion 452 and a pair of legs 454 that terminate in free ends 456. The free ends are attached to connectors 460. Each connector 460 also has a flange portion 462 at one end thereof. The flange portion 462 is pivotally attached to the U-shaped rear frame 450 to allow the U-shaped rear frame 450 to pivotally move relative to the U-shaped back frame 120. The flange portion 462 has a concave shaped channel for receiving the tubular structure of the U-shaped back frame 120 when the U-shaped rear frame 450 is in a fully extended position (e.g., the U-shaped rear frame 450 is oriented perpendicular to the U-shaped back frame 120).

The first storage receptacle 200 is disposed along a rear surface of back panel 121 of the U-shaped back frame 120 near a top thereof. The first storage receptacle 200 can be in the form of a storage pouch made of cloth or other material. In one embodiment, the back panel 121, seat panel 111, and the first storage receptacle 200 can be formed of the same material. The first storage receptacle 200 can thus be a pouch having a rear panel, a front panel, a bottom panel and an openable/closeable top panel 205 that define a hollow interior compartment for storage of items and the like. The top panel (e.g., a flap) 205 can be fastened to top edges of the other panels by a fastener or like, such as a zipper 201. It will be appreciated that for the fastener 201, other types of fasteners can be used, such as snaps, buttons, hook and loop material, etc. Each of these panels that define the first storage receptacle 200 can include an inner insulation layer to define an insulated storage receptacle for storing cold drinks and the like.

The zipper 201 thus serves to open and close the first storage receptacle 200 and extends across a top thereof and serves to connect the top panel 205 to the front panel of the first storage receptacle 200.

The first storage receptacle 200 can have any number of different shapes and come in different sizes as well.

The panels of the first storage receptacle 200 can be connected to one another using traditional techniques, including the use of stitching. In addition, the rear panel of the first storage receptacle 200 can be selectively connected to the back panel 121 using the same techniques, such as the use of stitching. In the illustrated embodiment, the rear panel of the first storage receptacle 200 is connected to the back panel 121 along its two opposing sides and along its bottom but not along its top. As a result, an accessible space (the second storage receptacle as discussed below) is formed behind the rear panel of the first storage receptacle 200 (between the rear panel and the back panel 121) and this space is accessible from the top.

The first storage receptacle 200 is thus disposed between the legs of the U-shaped back frame 120.

The chair 100 includes a second storage receptacle (storage compartment) 400 that is formed between the back panel 121 attached between the U-shaped back frame 120 and the rear panel of the first storage receptacle 200. An entrance to the second storage receptacle 400 is thus located behind the rear panel of the first storage receptacle 200. As shown, in order for the second storage receptacle 400 to be an openable and closeable space, a fastener 401, such as a zipper, is provided. It will be appreciated that for the fastener 401, other types of fasteners can be used, such as snaps, buttons, hook and loop material, etc. The length of the zipper 401 can be less than the length of the zipper 201. The zipper 401 is secured to the back panel 121 using a pair of patches 409 one at each of the zipper 401. More specifically, each patch (which can be formed as the same material as the back panel 121) is connected along its outer end and top and bottom edges to the back panel 121, while the inner edge thereof is only attached to the zipper 401 for support thereof. The top tape of the zipper 401 is attached (stitched) the back panel 121, while the bottom tape of the zipper 401 is attached (stitched) to the rear surface of the rear panel of the first storage receptacle 200. In this manner, when the zipper 401 is closed, the space between the rear panel of the first storage receptacle 200 and the back panel 121 is closed off.

The foot print of the second storage receptacle 400 is defined in part by the rear panel of the first storage receptacle 200 since the second storage receptacle 400 is located behind the rear panel that is stitched to the back panel along its side edges and bottom edge. The second storage receptacle 400 is thus a space that is located between the rear panel of the first receptacle 200 and the back panel 121 of the chair 100.

The chair includes a pair of straps 500. Each strap 500 includes a first end 502 and an opposing second end 504. The strap 500 has a first padded portion 510 that terminates at the first end 502 and a lower strap portion 520 that terminates at the second end 504. The length of the lower strap portion 520 can be adjusted using a buckle 530 that is located along the length of the lower strap portion 520. At the second end 504 of the strap 500, a clip 540 is provided and is attached to the bottom end of the lower strap portion 520. The clip 540 has a movable actuator that opens and closes the clip 540. In the closed position, the clip 540 has a bounded hole and in the open position, the clip 540 has an open slot to permit passage into the center hole. The actuator is biases to the closed position so that at rest, the clip 540 remains closed. The clip 540 can be formed of a plastic material.

The chair 100 also includes a pair of connectors (coupling members) 550 that are attached to one of the back panel and the seat panel proximate or about the cross member 130. Each connector 550 can be in the form of a strap 552 that is connected to one or both sides of the pocket 133. As illustrated, the strap 552 can be a looped structure with a D-ring 555 captured thereby, with one end of the strap 552 being attached to one side of the pocket 133 and the other end of the strap 552 being attached to the other side of the pocket 133. The D-ring 555 can be a plastic part. The connectors 550 are spaced apart from one another along the cross member 130 and are located closer to the ends of the cross member 130 than the center thereof.

The clip 540 is constructed so as to be detachably connected to the D-ring 555 so as to securely attach the lower strap portion 520 to the chair frame by interlocking the clip 540 and D-ring 555. As mentioned, the other end (first end 502) of the strap 500 is fixedly attached to the support panel (e.g., back panel 121) and more particularly, the first end 502 is located internally within the second storage receptacle 400.

It will be understood that in some embodiments, the D-rings 555 (and connectors 550 for that matter) can be eliminated. For example, the clips 540 of the straps 500 can be attached to the cross-bar 130 or can be attached to another structure, thereby resulting in the straps 500 being attached at both ends. In addition, the at least one support panel can be formed to have pieces of fabric attached thereto so as to define a loop or the like that can receive the clip 540, thereby attaching the strap 500 at its lower end 504.

Figure 2A:
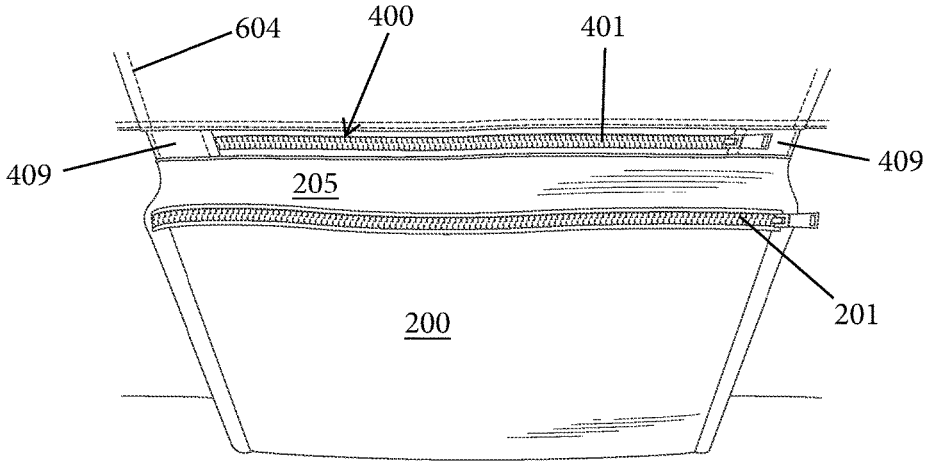
FIG. 2A is a perspective view of first and second storage receptacles that are located along a back panel of the folding chair and are shown in closed positions.

The chair 100 is configured such that the straps 500 can be hidden from view when the chair 100 is in an in-use position as shown in FIG. 2A. More specifically, the clips 540 are detached from the D-rings 555, thereby freeing the second ends 504 of the straps 500. These free send ends 504 of the straps 500 are then inserted into the second storage receptacle 400. Since the first ends 502 of the straps 500 are located within the interior space of the second storage receptacle 400, the insertion of the free second ends 504 of the straps 500 into the same interior space of the second storage receptacle 400 results in the entire straps 500 being concealed and hidden from view, especially when the fastener 401 is closed resulting in the second storage receptacle 400 being closed as shown in FIG. 2A. Unlike other backpack chairs in which the straps are entirely visible regardless of the position of the chair, the straps 500 in the present invention can be completely concealed when the chair 100 is in the in-use position.

Figure 2B:
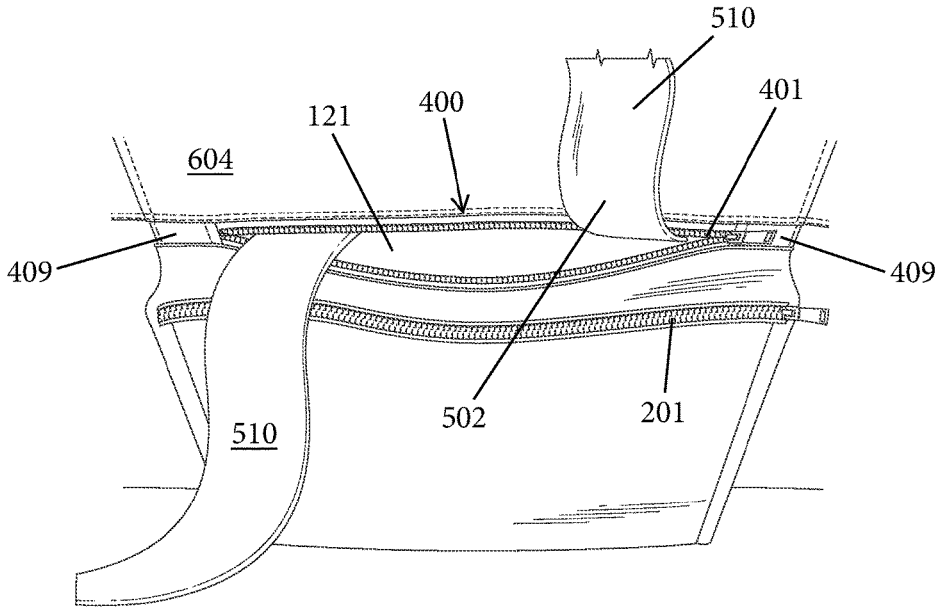
FIG. 2B is a perspective view of the first and second storage receptacles with the first storage receptacle being shown in the closed position and the second storage receptacle being shown in the open position with a pair of straps being shown as protruding outwardly from the second storage receptacle.
Figure 3:
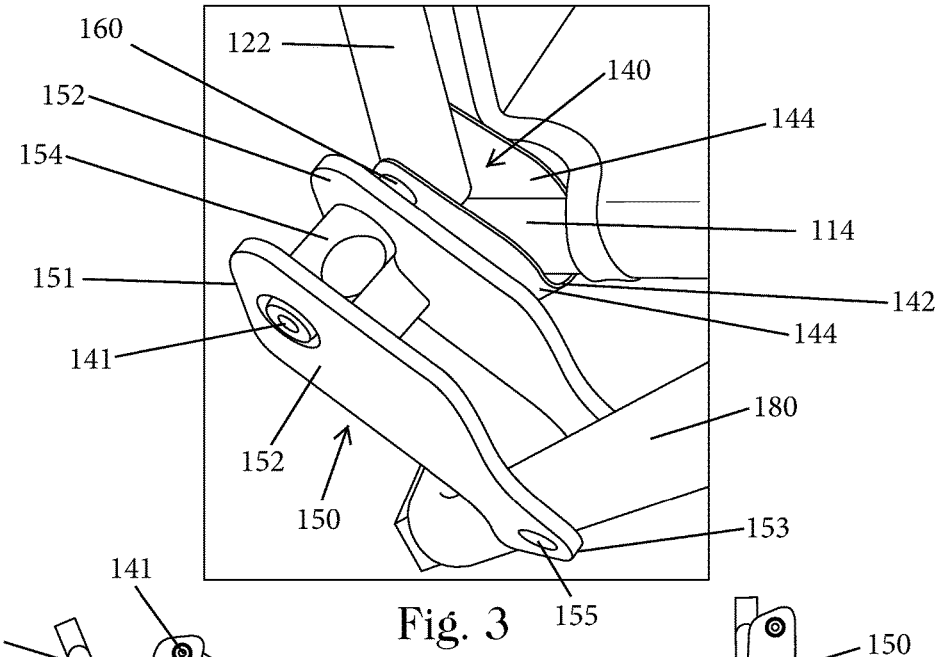
FIG. 3 is a perspective view shown a connection between a U-shaped rear frame and a U-shaped seat frame.

FIG. 2B shows the in-use position in which the straps 500 are contained outside of the second storage receptacle 400 and are accessible to permit attachment of the straps 500 to the connectors 550 (i.e., the D-rings 555).

Figure 8:
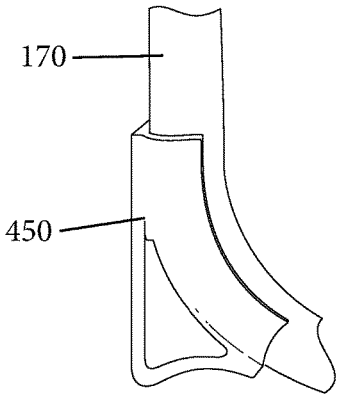
FIG. 8 is a side view of a leg stabilizing member.

In order to create additional stabilization, as shown in FIGS. 1 and 8, each of the U-shaped front leg frame 170 and the U-shaped rear leg frame 180 can include a level accessory 450 that is intended to be disposed in the corner of each of the U-shaped front leg frame 170 and the U-shaped rear leg frame 180. The accessory 450 includes a planar bottom and has a body portion that surrounds the curved tubular structure of one corner of one of the U-shaped front leg frame 170 and the U-shaped rear leg frame 180. By positioning the accessories 450 in each corner of the U-shaped front leg frame 170 and the U-shaped rear leg frame 180, the corners are stabilized and the chair 100 is less apt to tip over.

Figure 10:
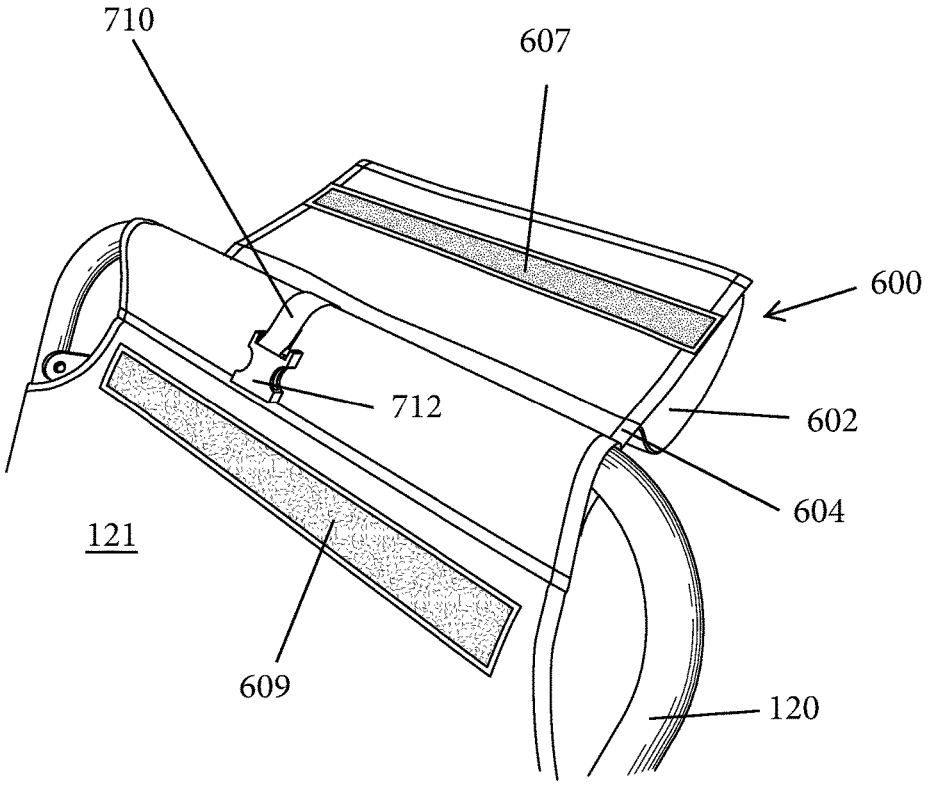
FIG. 10 is view of a raised pillow that reveals a connector used to attach the back frame to the seat frame in the folded position of the chair.

As shown in FIG. 10, the chair 100 can includes a headrest or head pillow 600 that can be positioned along the front face of the back panel 121. The head pillow 600 has a main pillow portion 602 and a connector portion 604 that fixedly attaches the main pillow portion 602 to the rear face of the back panel 121 and permits the main pillow portion 602 to be detached from the front face and repositioned. The connector portion 604 can be in the form of a strap/piece of material that can be stitched to the rear face of the back panel 121 and also represents a hinge that allows the pillow 600 to be moved to different positions. In particular, the head pillow 600 can be moved between an in-use position in which the head pillow 600 is attached to front face and a pivoted position in which the head pillow 600 is lifted off of and away from the front face. To detachably attach the head pillow 600 to the back panel 121, fasteners, such as hook and loop material, can be used. For example, a first piece 607 of hook and loop material can be attached to the back of the head pillow 600 and a second piece of hook and loop material 609 can be attached to front face of the back panel 121.

Figure 9:
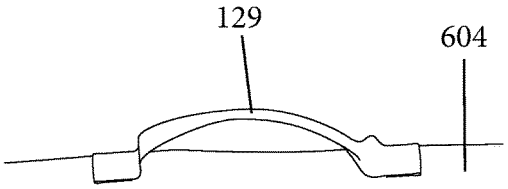
FIG. 9 is a view of an optional handle.

As shown in FIGS. 1 and 9, the chair 100 also has a mechanism for maintaining the chair 100 in its fully folded position. For example, a first fastener 700 is coupled to the U-shaped seat frame 112 (e.g., to the support panel 111 coupled to the frame 112) and a second fastener 710 that is coupled to the U-shaped back frame 120. When the first and second fasteners 700, 710 mate with one another, when the chair 100 is in the fully folded position, the U-shaped seat frame 112 and the U-shaped back frame 120 are coupled to one another.

The first fastener 700 can be in the form of a strap that has a first connector (buckle) 702 formed at one end thereof and similarly, the second fastener 710 has a strap that has a second connector (buckle) 712 that mates with first connector 702. The first buckle 702 can be one of a male part or female part and the second buckle 712 can be the other of a male part or female part.

When the head pillow 600 is in its in-use position and is attached to the front face of the back panel 121, the second fastener 710 is hidden underneath the head pillow 600. The attached end of the second fastener 710 can be attached to the rear face of the back panel 121 as shown. The attached end of the first fastener 700 can be located near the cross member of the U-shaped seat frame 112.

As shown, the top face of the connector portion 604 can include a handle 129 (FIG. 9) that allows the chair 100 to be easily transported.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A backpack type folding chair comprising:

a chair frame including a seat frame, a back frame, a front leg frame, and a back leg frame, the back frame being coupled to the seat frame, the front leg frame and the back leg frame being pivotally coupled to one another, the seat frame having a cross member extending across legs of the seat frame, the chair frame being configured to fold such that the back frame, the seat frame, the front leg frame and the back leg frame fold substantially parallel and adjacent to one another;

a pair of arm rests pivotally coupled to the back frame and being configured to have a plurality of adjustment positions;

at least one support panel to support a user coupled about the back frame and the seat frame and associated with the cross-member;

a first storage receptacle coupled to a rear face of a backrest portion of the at least one support panel that is coupled to the back frame;

a second storage receptacle defined by and between the first storage receptacle and the backrest portion; and a pair of detachable shoulder straps, each of which includes a first end that is attached along the rear face of the back rest portion within the second storage receptacle and a second end that includes a first fastener that is configured to mate with a coupling member that is attached to the at least one support panel proximate the cross member for attaching the second end of the shoulder strap to the chair and permit carrying of the chair in a folded position, wherein the pair of shoulder straps can be stored in the second storage receptacle when the chair is in an in-use position.

2. The backpack type folding chair of claim 1, wherein the at least one support panel comprises a seat support panel and a back support panel.

3. The backpack type folding chair of claim 1, wherein the first fastener comprises a clip.

4. The backpack type folding chair of claim 1, wherein the coupling member comprises a D-ring.

5. The backpack type folding chair of claim 1, wherein the at least one support member comprises a single support panel that is disposed over the cross member and is attached to itself proximate the cross member to define a pocket that contains the cross member, the coupling member being attached to the pocket.

6. The backpack type folding chair of claim 5, wherein the coupling member includes a strap and a D-ring attached thereto.

7. The backpack type folding chair of claim 6, wherein one end of the strap is located along one face of the pocket and the other end of strap is located along another face of the pocket.

8. The backpack type folding chair of claim 1, wherein the first end of each strap is located within the second storage receptacle.

9. The backpack type folding chair of claim 8, wherein the first end of each strap is attached to the backrest portion of the at least one support panel.

10. The backpack type folding chair of claim 8, wherein the pair of straps extend over the first storage receptacle.

11. The backpack type folding chair of claim 1, wherein the first storage receptacle includes a second fastener for closing the first storage receptacle and the second storage receptacle includes a third fastener for closing the second storage receptacle.

12. The backpack type folding chair of claim 11, wherein each of the second fastener and the third fastener comprises a zipper, the third fastener being located behind and above the second fastener.

13. The backpack type folding chair of claim 1, wherein the first storage receptacle is attached to the rear face of a backrest portion along two opposing sides and a bottom of the first storage receptacle with a top being unattached to allow access to the second storage receptacle.

14. The backpack type folding chair of claim 13, wherein a rear panel of the first storage receptacle is attached to the back rest portion along opposing side edges and a bottom edge with a top edge of the rear panel being detached from the rear panel, wherein the second storage receptacle that is defined between the rear panel of the first storage receptacle and the back rest portion, the second storage receptacle having a second fastener that is attached to the top edge of the rear panel for closing off the second storage receptacle.

15. The backpack type folding chair of claim 14, wherein the second fastener comprises a zipper that includes a bottom tape that is attached to the top edge of the rear panel and a top tape that is attached to the backrest portion.

16. A backpack type folding chair comprising:

a chair frame including a seat frame, a back frame, a front leg frame, and a back leg frame that move between an in-use extended position and a folded position in which the seat frame, a back frame, a front leg frame, and a back leg frame fold substantially parallel and adjacent to one another;

at least one support panel to support a user coupled about the back frame and the seat frame;

a first storage receptacle having at least a rear panel that is attached to a rear face of a backrest portion of the at least one support panel that is coupled to the back frame, the first storage receptacle being disposed within the back frame, the first storage receptacle having a first access opening formed along a top edge thereof;

a second storage receptacle defined between the rear panel of the first storage receptacle and the backrest portion, the second storage receptacle having a second access opening formed along a top edge thereof and being separate and spaced from the first access opening; and a pair of detachable shoulder straps, each of which includes a first end that is attached along the rear face of the back rest portion and is located within the second storage receptacle and a second end that includes a first fastener that is configured to mate with a coupling member for attaching the second end of the shoulder strap to the chair and permit carrying of the chair in the folded position, wherein the pair of shoulder straps can be completely stored in the second storage receptacle when the chair is in the in-use extended position.

17. The backpack type folding chair of claim 16, wherein the coupling member comprises a cross bar that extends across legs of the seat frame.

18. The backpack type folding chair of claim 16, wherein the coupling member comprises a connector that is attached to the at least one support panel.

19. The backpack type folding chair of claim 16, further including a first connector that is attached to the at least one support panel at a location proximate the seat frame and a second connector that is at attached to the at least one support panel at a location proximate the back frame, wherein the first and second connectors are positioned such that in the folded position, the first and second connectors attach to one another for ensuring the chair remains in the folded position.

20. The backpack type folding chair of claim 19, wherein one of the first connector and the second connector comprises a male buckle part and the other of the first connector and the second connector comprises a complementary female buckle part.

21. A backpack type folding chair comprising:

a chair frame including a seat frame, a back frame, a front leg frame, and a back leg frame that move between an in-use extended position and a folded position in which the seat frame, a back frame, a front leg frame, and a back leg frame fold substantially parallel and adjacent to one another;

at least one support panel to support a user coupled about the back frame and the seat frame; a storage receptacle having at least a rear panel that is attached to a rear face of a backrest portion of the at least one support panel that is coupled to the back frame, the storage receptacle being disposed within the back frame, the first storage receptacle having a first access opening formed along a top edge thereof, wherein the storage compartment is located between the rear panel and the back rest portion a storage compartment defined by and between the at least one support panel and the rear panel; and a pair of detachable shoulder straps, each of which includes a first end that is attached to the at least one support panel and is located within the storage compartment and a second end that includes a first fastener that is configured to mate with a coupling member for attaching the second end of the shoulder strap to the chair and permit carrying of the chair in the folded position, wherein the pair of shoulder straps can be completely stored in the storage compartment when the chair is in the in-use extended position.

22. The backpack type folding chair of claim 21, further including:

a repositionable pillow that is attached to the at least one support panel; and a first connector that is attached to the at least one support panel at a location proximate the seat frame and a second connector that is at attached to the at least one support panel at a location proximate the back frame, wherein the first and second connectors are positioned such that in the folded position, the first and second connectors attach to one another for ensuring the chair remains in the folded position;

wherein when the pillow is positioned along a front face of the at least one support panel, the second connector is fully concealed by the pillow.

* * * * *